US006142093A

United States Patent [19]

Kulczycki

[11] Patent Number: 6,142,093

[45] Date of Patent: Nov. 7, 2000

[54] METHOD FOR BUILDING LAPSTRAKE BOATS

[76] Inventor: Christopher G. Kulczycki, 832 Locust Dr., West River, Md. 20778

[21] Appl. No.: 09/391,428

[22] Filed: Sep. 8, 1999

[51] Int. Cl.[7] ..... B63B 3/00

[52] U.S. Cl. ..... 114/355; 114/357; 114/358; 114/84; 114/82

[58] Field of Search ..... 114/355, 358, 114/357, 65 R, 82, 84, 86, 88

[56] References Cited

U.S. PATENT DOCUMENTS

| | | | |
|---|---|---|---|
| 578,239 | 3/1897 | House | 114/84 |
| 1,637,973 | 8/1927 | Thompson | 114/82 |
| 2,397,049 | 3/1946 | Sandison | 114/82 |
| 2,700,357 | 1/1955 | Winter | 114/358 |
| 3,246,349 | 4/1966 | Lyon | 114/84 |
| 4,550,674 | 11/1985 | Zatek | 114/82 |

*Primary Examiner*—Stephen Avila

[57] ABSTRACT

A method for building lapstrake boats without use of a strongback and molds, and without the need to cut bevels on the strakes. The two-dimensional shape of each strake is determined and the strakes are cut to these shapes. A groove, or rabbet, is cut in the bottom inside edge of each, but the bottom, strake. The strakes are fastened or clamped so the top edge of each plank fits into the rabbet in the bottom of the adjacent strake. This has the effect of holding the strakes in alignment. The joints are filled with epoxy or other cementitious material making a strong stiff bond. One or more frames, bulkheads, or other interior components may be inserted as needed to maintain the strakes in the desired shape.

5 Claims, 4 Drawing Sheets

METHOD FOR BUILDING LAPSTRAKE BOATS

CROSS-REFERENCE TO RELATED APPLICATIONS

Not applicable

STATEMENT REGARDING FEDERALLY SPONSORED RESEARCH AND DEVELOPMENT

Not applicable

REFERENCE TO MICROFICHE APPENDIX

Not applicable

BACKGROUND OF THE INVENTION

This invention relates to the construction of boats, specifically to the construction of lapstrake planked boat hulls.

Lapstrake planking is a traditional method of wooden boat building that has been in use for thousands of years. Like most wooden boats, lapstrake boats are built of planks, or strakes 1, which comprise the boat's hull. In lapstrake construction, each strake overlaps and is fastened to the outside face of the strake below. In other planking methods, the strakes are joined edge-to-edge.

Many boat builders favor the lapstrake method of building because it results in a boat that is less expensive and faster to build than one built with other traditional methods. Many boat owners also favor lapstrake construction for its aesthetic qualities, light weight, and lower construction costs. Lapstrake hulls are known to deflect water downward and thereby provide a "drier ride" then other hull types.

Lapstrake boat hulls are most often built over a strongback 2 and molds 3 as illustrated in FIG. 1A. The strongback is a frame to which molds that define the cross-sectional shape of the hull are attached. This structure forms the upside down shape of the hull. Individual strakes are shaped so as to cover the molds. Then the strakes nearest the keel are attached to the molds. A bevel 4, or angle, is cut in the edge of each strake and the next strake is attached to it using mechanical fasteners and/or glue as shown in FIG. 1B. The remaining strakes are attached in this manner until the hull is completed. Upon completion of planking, the hull is removed from the frame. Permanent frames, bulkheads, and other components may be incorporated into the molds and removed as part of the hull. Alternately, the frames, bulkheads or other components may be added to strengthen the hull after it is removed from the mold. There are several disadvantages to this method:

(a) It is time consuming and costly to construct a strongback 2 and molds 3 for each type of boat built; often, as much time is required to build the strongback and molds as to assemble the hull.

(b) The shape of each strake 1 is determined by holding it against the molds. Each pair of planks, one for the port and one for the starboard side, are individually shaped and fit to the molds. This is a time consuming and exacting process demanding substantial skill on the builder's part.

(c) A rolling, or constantly varying, bevel 4 must be cut in the edge of the strakes. This is time consuming and exacting, and it requires considerable skill of the builder.

An alternate method of lapstrake planking is historically used in the Scandinavian countries. The hull is built without a strongback and molds. It is built right side up; the hull shape is established by placing posts under it and by using beams wedged against the ceiling of the workshop to form the strakes. Though this method eliminates the need to build a strongback and molds, it does have other disadvantages:

(a) It requires a boatbuilder possessing substantial skill, artistry, and experience, since the overall shape of the hull is largely determined by "eye" as it is being built, rather than by the molds.

(b) A rolling, or constantly varying, bevel must be cut or planed into each strake in order to attach the next strake. This is time consuming and exacting, and it requires considerable skill of the builder.

(c) The shape of each strake is determined by eye and fit to the boat without the molds to guide the builder. Each pair of planks, one for the port and one for the starboard side, are individually cut and fit without the aid of the molds. This is a time consuming process demanding substantial skill on the builder's part.

(d) In practice, this method is limited as to the hull shapes that can be built.

A more recent method illustrated in FIG. 2, termed "stitch-and-glue construction," also allows building boats without strongbacks and molds. The development of computer boat design programs has made it possible to easily determine the strake's exact shape, or expansion, and to cut the strakes prior to building the molds. Both the two-dimensional shape (that is, the shape when the strakes are cut from wood or other flat stock) and their three-dimensional shape (the shape after the strake is bent to form part of the hull) of the strakes can be calculated. Boats are now built without strongbacks and molds by butting the edges of the strakes and joining them with epoxy fillets 5 and fiberglass reinforced plastic 7. This technique has the following disadvantages:

(a) The hull is not lapstrake construction that is favored by many boat builders for reasons of aesthetics as well as for reasons of functionality and economy.

(b) This method demands extensive use of fiberglass and resins, which results in increased cost and increased environmental impact.

(c) Fiberglass reinforced joints require additional sanding and finishing, particularly if the hull is to be finished with varnish or other clear coating, which many owners desire for aesthetic reasons.

A further refinement of the stitch-and-glue technique, illustrated in FIG. 4, involves overlapping the strakes 1 of a design to make a lapstrake boat. Flexible plastic rivets 6 are used to hold the strakes in position. The inventor knows of no articles or books describing this method as it has been developed in the past few years. This method has the following disadvantages:

(a) It is difficult to hold such overlapped strakes in alignment since the forces of bending and twisting the strakes cause them to slip prior to being bonded. The plastic rivets must flex in order to accommodate the changes in angle between the strakes as the hull is assembled. This flexibility makes it difficult, if not impossible to precisely align the strakes.

(b) Given the large number of strakes in some designs, the accumulated error caused by the changes, or errors, in the strakes' position may result in hull shapes substantially different than those the designer envisioned.

(c) The rivets must be placed with great precision to assure the most accurate possible alignment of the strakes.

(d) The lack of accuracy in strake alignment limits this method to boats with little bend in the strakes and does not allow designs containing substantial twist in the strakes-powerboats with both flare and tumblehome in the hulls, for example.

(e) The amount of overlap between the strakes may not be consistent, which is detrimental to the aesthetics of the boat.

BRIEF SUMMARY OF THE INVENTION

My invention allows a wide range of lapstrake-type boat hulls to be built without a strongback 2 and molds 3, and without the need to cut bevels 4 on the strakes 1. It requires less time and skill than current methods. This method involves finding the two-dimensional shape of each strake using a computer program, cutting the strakes, cutting a rabbet 9 in the lower inside edge of the strakes, and assembling the hull without a strongback or molds. The self-aligning nature of the rabbet at the strake edge simplifies assembly of the hulls and ensures that the strakes are assembled with great accuracy. My invention addresses all of the drawbacks of prior methods as described above.

OBJECTS AND ADVANTAGES OF THE INVENTION

Accordingly, several objects and advantages of my invention are:

(a) to provide a method where lapstrake boats are planked without need for a strongback and/or molds;

(b) to provide a method of lapstrake construction where the cutting or planing of bevels on plank edges is not required;

(c) to provide a simplified method of lapstrake construction heretofore the domain of skilled professional boat builders or students of boat building, thereby expanding the accessibility of such construction to home builders or builders with limited experience;

(d) to provide a method of boat construction that is applicable to a wider range of hull shapes than current construction methods allow;

(e) to provide a method of lapstrake construction where all the strakes can be cut and prepared prior to constructing the boat, thus speeding production time in that parts can be made and shipped from a production facility to home builders or regional boat shops.

(f) to provide a method of lapstrake boat construction where all strakes may be cut on a numerical control router, thus lowering production cost and speeding production time for components;

(g) to provide a method of lapstrake boatbuilding that allows assembly of the hull to be more economical than prior methods;

(h) to provide a method of building where the boat may be completed in substantially less time than is possible with prior methods;

(i) to provide a lapstrake joint with substantial surface area to allow a stronger glue joint and eliminate or reduce the need to reinforce joints with fiberglass reinforced plastics and/or epoxy fillets in boats built without strongbacks and forms;

(j) To provide a lapstrake joint that aids in aligning the strakes as they are being joined and serves as an index to allow the builder to check that the strakes are properly overlapped and aligned;

(k) To provide a method of boat building that requires less use of potentially unhealthy and environmentally harmful resins than many commonly used methods.

Since this invention 11 months ago, at least 10 boats of various designs from 8 to 18 feet long have been built and tested. Furthermore, 3 of these models have gone into series production as kit-boats for home completion and over 60 have been sold. Many of these have already been completed and are in use. Further objects and advantages of my invention will become apparent from a consideration of the drawings and ensuing descriptions.

BRIEF DESCRIPTION OF THE SEVERAL VIEWS OF THE DRAWINGS

In the drawings, closely related figures have the same number but different alphabetic suffixes.

Reference Numerals in Drawings

Figure 1A:
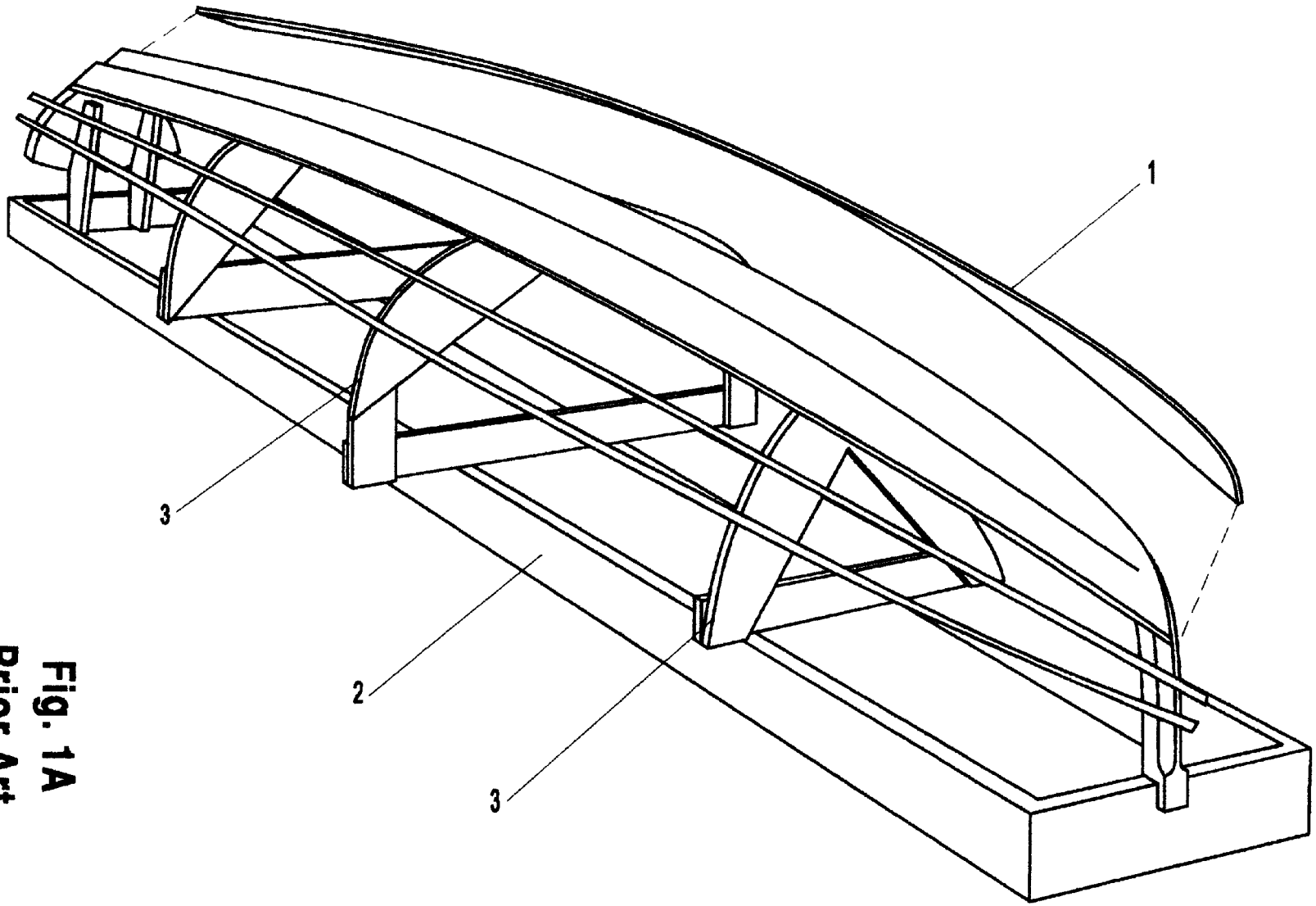
Fig. 1A Prior Art
FIG. 1A is an isometric view of prior art lapstrake boat construction using a strongback and molds.
Figures 1B, 2, 3:
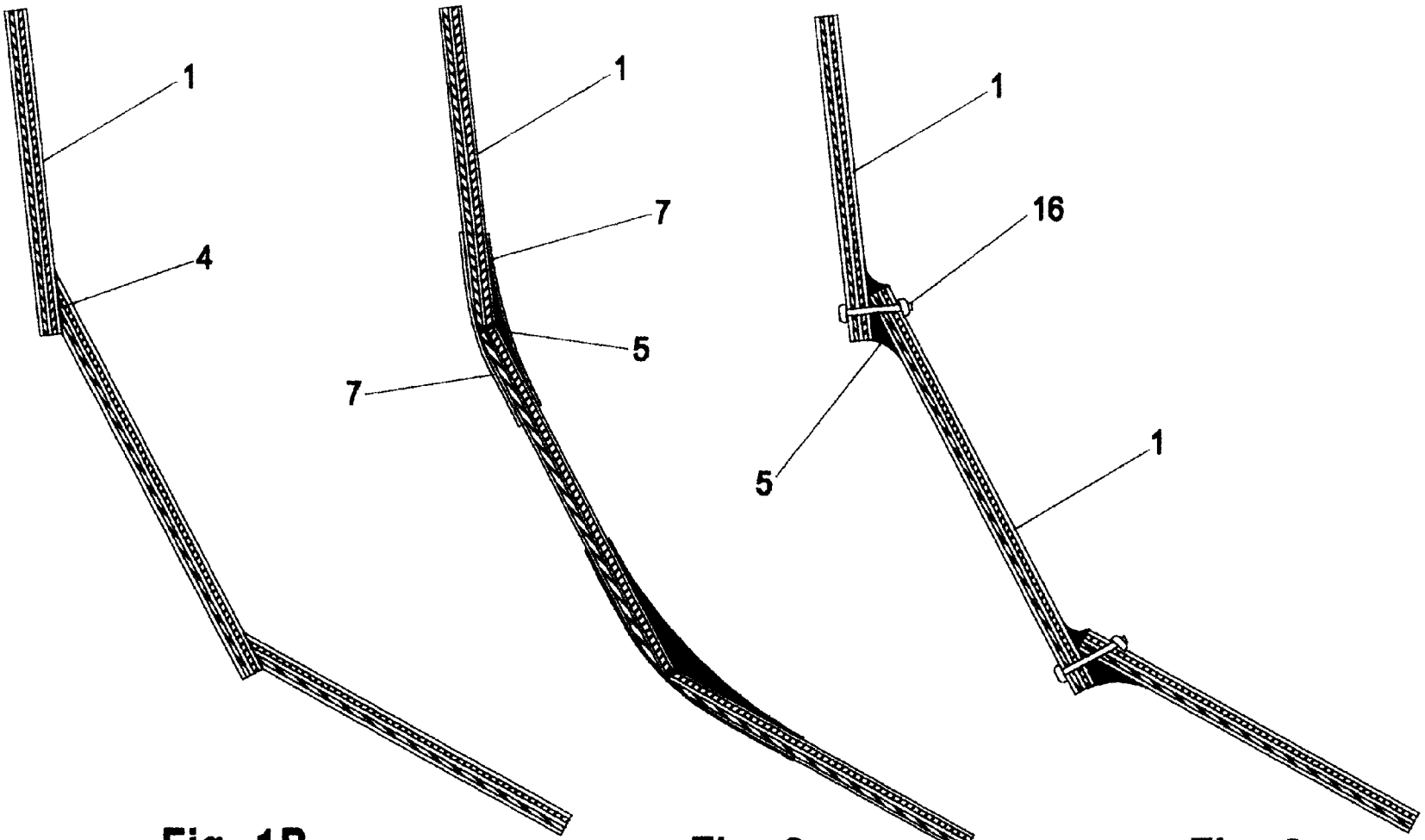
Fig. 3 Prior Art
Fig. 2 Prior Art
Fig. 1B Prior Art
FIG. 1B is a vertical cross sectional view of a prior art lapstrake boat construction strake joint.
FIG. 2 is a vertical cross sectional view of a prior art stitch-and-glue joint.
FIG. 3 is a vertical cross sectional view of a prior art lapstrake boat construction joint using a non-beveled strake joint.

1. strake
2. strongback
3. mold(s)
4. lap joint with bevel
5. epoxy fillet
6. flexible plastic rivet
7. fiberglass reinforced plastic
8. temporary tie
9. rabbet
10. inside face of strake
11. outside face of strake
12. top edge of strake
13. bottom edge of strake
14. cementitious matter
15. transom
16. plastic rivet

DETAILED DESCRIPTION OF THE INVENTION

Figure 4A:
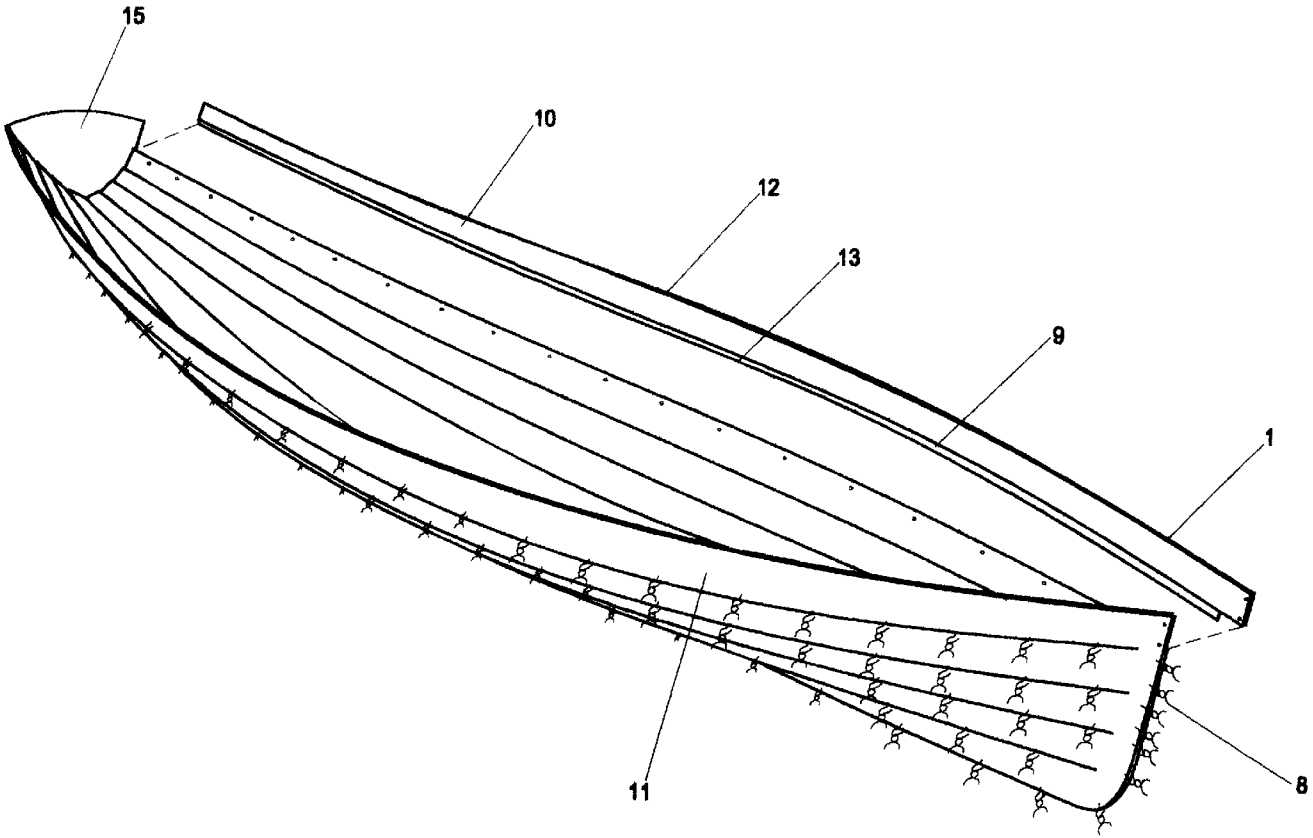
FIG. 4A is an isometric view of one embodiment of the improved strake joint of the present invention.
Figure 4B:
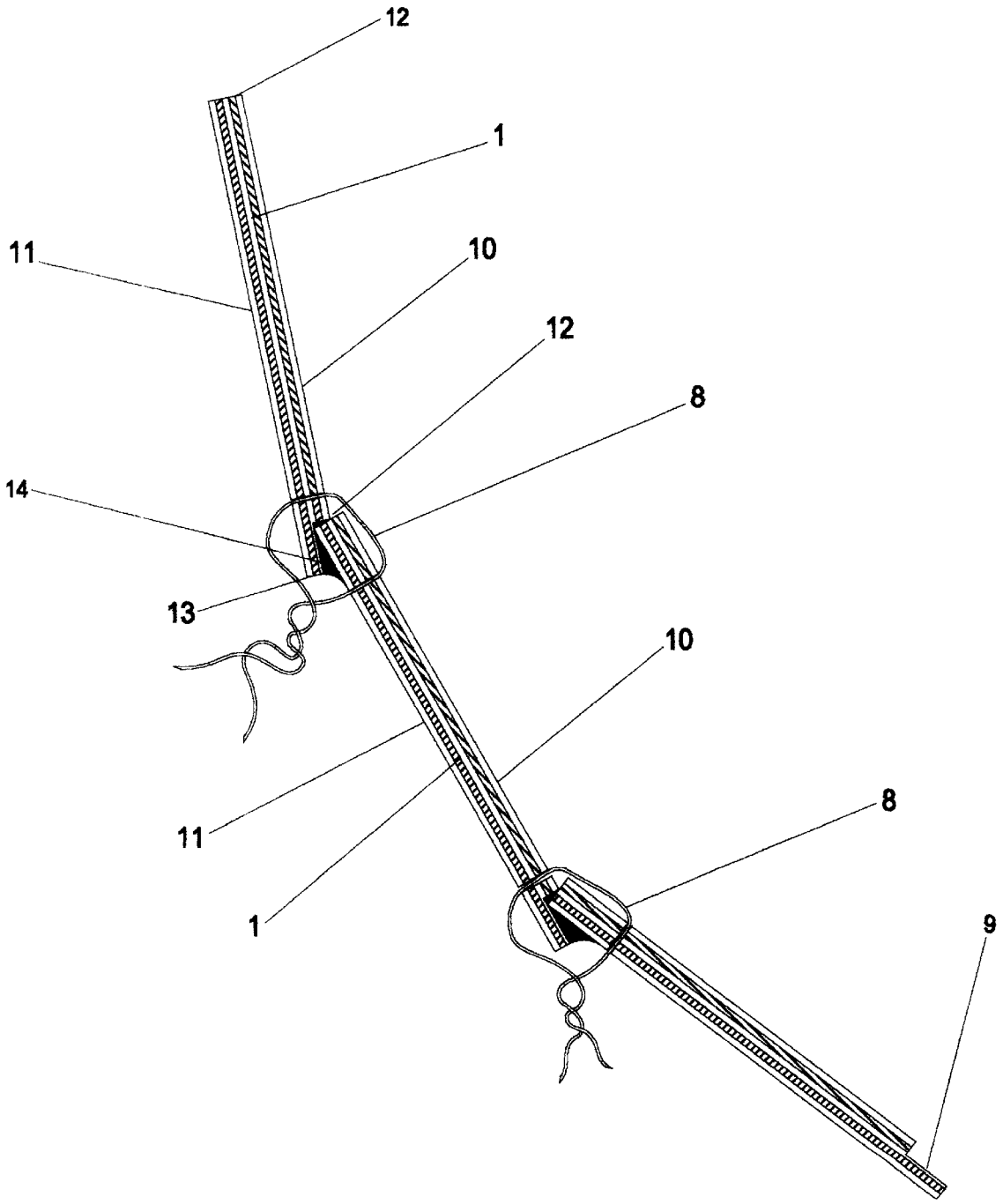
FIG. 4B is a vertical cross sectional view of the same embodiment showing the rabbet cut at 90 degrees to the bottom edge of the strake and other details of the joint.

The preferred embodiment of the improved strake joint of the present invention is illustrated in FIG. 4A (isometric view) and FIG. 4B (vertical cross-sectional view).

A boat is designed and drawn in the conventional manner. The three-dimensional shape of each strake 1 is redrawn to show the two-dimensional shape, or expanded shape of the strake. This may be done using a computer aided design program or the panel expansion drafting technique. Many commercial boat-design computer programs include panel expansion features that allow the designer or builder to quickly determine the two-dimensional shape of the strakes, and most builders would choose to use one of these programs.

The strake is cut out from wood, plywood, or other sheet material according to two-dimensional templates or dimensions gained from the computer design program or panel expansion drafting. The strake may be cut using conventional methods such as a handheld saw, band saw, or router. A computer numerical control router, computer numerical control laser cutter, or other method may also be used to cut the strake. Unlike traditional lapstrake construction, all strakes may be cut prior to beginning assembly.

A rabbet 9 is cut at the intersection of a bottom edge 13 and an inside face 10 of each, but the bottom, strake. Rabbet 9 may be cut at an angle of 90 degrees to the face and edge of the strake as illustrated in FIG. 4B. Alternatively, the rabbet may be cut at an angle of other than 90 degrees to the face and edge of the strake to reduce the gaps in the joint between the adjoining strakes. The rabbet may be cut with a handheld router, table saw, hand rabbet plane, power jointer, computer numerical control router, or other cutting tool. This rabbet replaces the bevel used in traditional lapstrake construction and a bevel is not cut.

The strake is fastened or clamped to a second strake so that a portion of a top edge 12 and a portion of an outside face 11 of the first strake fit into the rabbet in the bottom of the second strake. This has the effect of holding the strakes in alignment. A temporary tie 8, wire or plastic, or other mechanical fastener is used to hold the strakes together. If a temporary tie 8 is used, a series of holes is drilled in each strake, and the temporary tie is inserted through the corresponding holes in adjacent strakes in such a way as to join them. The ties are twisted or locked so as to hold a portion of top edge 12 and outside face 11 of one strake firmly in the rabbet 9 of the adjoining strake. The fasteners must allow the strakes to flex at the joint, as the shape of the hull may change as it is being assembled and additional strakes are added.

One or more frames, bulkheads, transom 15, or other interior components may be inserted, as needed, to bring the strakes to, and maintain the strakes in, the desired shape. The shape of the boat or object being built, and the stiffness of the strakes, will determine the number and location of frames, bulkheads, or other internal members.

The strakes are permanently joined with epoxy or other cementitious material 14. The epoxy or other cementitious 14 material fills any gap between the rabbet and the adjoining strake making a strong stiff bond. The epoxy or other cementitious material may be injected into the rabbet 9 using an epoxy syringe or other device, or it may be poured into the rabbet of an up side down hull. When the epoxy or cementitious material has solidified, the ties or other fasteners may be removed and the boat may be painted or varnished.

Tests of the breaking strength of the strake joint made as described above show that it is as strong as a joint made with traditional lapstrake construction methods.

CONCLUSION, RAMIFICATIONS, AND SCOPE OF INVENTION

Thus the reader can see that: the method of construction of the invention allows a much-simplified and economical method of constructing lapstrake wooden boats; boats constructed using this method may be completed in substantially less time and require less skill to construct than those built using prior methods; and proper alignment and overlap of the strakes comprising the hull is assured.

While my above description contains many specificities, these should not be construed as limitations on the scope of the invention, but rather as exemplifications of one preferred embodiment thereof. Many other variations are possible. For example:

(a) Bow roofs on barns and other buildings and structures (b) Entire buildings (c) Barrels and water tanks (d) Decorative furniture such as boat shaped baby cradles As noted earlier over 10 boat models have been built using this method. They have proven easy to build, durable, and commercially successful.

I claim:

1. A method for building lapstrake boats comprising the steps of:

(a) providing a design for a boat and determining the two-dimensional shape of strakes, or planks, having a top edge, bottom edge, inside face and outside face, required to build said boat;

(b) cutting or fabricating said strakes;

(c) cutting into each said strake in the hull, but the bottom strake, at the intersection of said strake's lower edge and inside face, a rabbet running the length of said strake's lower edge and inside face;

(d) positioning said strakes together so that a portion of the upper edge and a portion of the outside face of one said strake, which does not containing said rabbet, fits into and is in contact with the rabbet in the bottom edge of the adjoining strake in such a manner that a portion of said strake adjacent to said rabbet overlaps the outside face of said adjoining strake and the angle between said strakes is between 30 and 180 degrees, and;

(e) bonding said strakes using a cementitious matter whereby said strakes are attached and do form said boat hull.

2. A method for building a boat as in claim 1 wherein said strakes are composed of plywood panels.

3. A method for building a boat as in claim 1 wherein said strakes are composed of plastic panels.

4. A method for building a boat as in claim 1 wherein said cementitious matter is composed of epoxy.

5. A method for building a boat as in claim 1 wherein transoms, frames, stringers, and bulkheads are added completing the hull.

* * * * *